US011035373B2

(12) United States Patent
Pae et al.

(10) Patent No.: US 11,035,373 B2
(45) Date of Patent: Jun. 15, 2021

(54) WATER PUMP INCLUDING SUPPORTING STRUCTURE FOR IMPELLER

(71) Applicant: COAVIS, Sejong-si (KR)

(72) Inventors: Wan Sung Pae, Sejong-si (KR); Hyun Tae Lee, Sejong-si (KR); Joon Seup Kim, Daejeon (KR)

(73) Assignee: COAVIS, Sejong-si (KR)

( * ) Notice: Subject to any disclaimer, the term of this patent is extended or adjusted under 35 U.S.C. 154(b) by 33 days.

(21) Appl. No.: 16/523,982

(22) Filed: Jul. 26, 2019

(65) Prior Publication Data

US 2020/0032808 A1 Jan. 30, 2020

(30) Foreign Application Priority Data

Jul. 27, 2018 (KR) ..... 10-2018-0087865

(51) Int. Cl.
*F04D 29/046* (2006.01)
*F04D 13/06* (2006.01)

(52) U.S. Cl.
CPC ..... *F04D 29/046* (2013.01); *F04D 13/06* (2013.01)

(58) Field of Classification Search
CPC ..... F04D 13/06; F04D 29/046
See application file for complete search history.

(56) References Cited

U.S. PATENT DOCUMENTS 5,785,013 A * 7/1998 Sinn ..... F04D 29/5813 123/41.44
6,663,362 B1 * 12/2003 Lentz ..... H02K 1/145 417/423.7
6,939,115 B2 * 9/2005 Knoll ..... F04D 29/047 417/423.12
9,360,015 B2 * 6/2016 Muizelaar ..... F04D 13/0626
9,702,370 B2 * 7/2017 Kalavsky ..... H02K 7/08
9,777,739 B2 * 10/2017 Hayashi ..... F16C 17/02
2003/0035740 A1 2/2003 Knoll et al.

FOREIGN PATENT DOCUMENTS

KR 20170079382 A 7/2017

* cited by examiner

*Primary Examiner* — Patrick Hamo
(74) *Attorney, Agent, or Firm* — McCoy Russell LLP

(57) ABSTRACT

Provided is a water pump including a supporting structure for an impeller having a lower manufacturing cost and having reduced noise and vibration characteristics compared to a conventional water pump including a supporting structure for an impeller. The water pump including a supporting structure for an impeller includes: a shaft; an impeller having the shaft inserted into a center of the impeller and rotating together with the shaft to discharge an introduced fluid; a core formed on an outer circumference of the shaft; a magnetic material formed on an outer circumference of the core and forming a magnetic field rotating the shaft connected to the core and the impeller; a pump housing the shaft, impeller and core; and a supporting member installed between an end of the shaft and the pump housing to support the shaft.

4 Claims, 6 Drawing Sheets

(PRIOR ART)

WATER PUMP INCLUDING SUPPORTING STRUCTURE FOR IMPELLER

CROSS-REFERENCE TO RELATED APPLICATIONS

This application claims priority under 35 U.S.C. § 119 to Korean Patent Application No. 10-2018-0087865, filed on Jul. 27, 2018, in the Korean Intellectual Property Office, the disclosure of which is incorporated herein by reference in its entirety.

TECHNICAL FIELD

The following disclosure relates to a water pump including a supporting structure for an impeller, and more particularly, to a water pump including a supporting structure for an impeller having a lower manufacturing cost and reduced noise and vibration characteristics compared to a conventional water pump including a supporting structure for an impeller.

BACKGROUND

An impeller refers to a compressor that moves fluid. Such an impeller is generally used in a pump.

FIG. 1 illustrates a process of manufacturing a conventional water pump including an impeller. As illustrated in FIG. 1, the conventional water pump including an impeller includes: a shaft (not illustrated); a carbon bushing 10 coupled to the shaft; a magnetic material molding 20 housing the carbon bushing 10 therein and embedding therein, a magnetic material 21 serving as a stator for rotating the shaft; an impeller 30 rotatably coupled to the shaft at one side of the magnetic material molding 20, discharging fluid introduced thereinto and including an upper impeller assembly 31 and a lower impeller assembly 32; and a pump housing (not shown) housing the carbon bushing 10, the magnetic material molding 20 and the impeller 30.

In order to serve as a rotating shaft, the shaft may rotate while being coupled to a central portion of the carbon bushing 10; and in order to support this shaft, a plurality of bearings are located between the carbon bushing 10 and the pump housing. When describing a position of each of the bearings in more detail with reference to FIG. 1, the bearing is coupled to a hole 11 of the carbon bushing 10 to support the impeller at a side of the shaft. Such a structure of the plurality of bearings has an increased manufacturing cost and excessive noise and vibration.

CITED REFERENCE

Patent Document

Korean Patent Laid-Open Publication No. 10-2017-0079382 (Entitled "Electric Water Pump with Waterproof Configuration," published on Jul. 10, 2017).

SUMMARY

An embodiment of the present disclosure is directed to providing a water pump including a supporting structure for an impeller which has a lower manufacturing cost and reduced noise and vibration characteristics.

In one general aspect, a water pump including a supporting structure for an impeller may include: a shaft; an impeller having the shaft inserted into a center of the impeller and rotating together with the shaft to discharge an introduced fluid; a core formed on an outer circumference of the shaft; a magnetic material formed on an outer circumference of the core and forming a magnetic field rotating the shaft connected to the core and the impeller; a pump housing housing the shaft, impeller and core; and a supporting member installed between an end of the shaft and the pump housing to support the shaft.

The pump housing may include an upper housing and a lower housing assembled to each other, and the upper housing and the lower housing have supporting structures housing and supporting the support members and both ends of the shaft, respectively.

The water pump including a supporting structure for an impeller may further include a bearing provided between the supporting structure and an outer circumference of an end of the shaft.

The support member may have a curved or flat surface in a shaft direction.

When the support member has a curved surface in the shaft direction, an end of the shaft in contact with the curved surface may be flat, and when the support member has a flat surface in the shaft direction, the end of the shaft in contact with the flat surface may be curved.

The support member may be a spherical ball, and a partial inner portion of the supporting structure may have a curved shape corresponding to a curved surface of the ball to house the ball therein.

Other features and aspects will be apparent from the following detailed description, the drawings and the claims.

DETAILED DESCRIPTION OF EMBODIMENTS

Hereinafter, a water pump including a supporting structure for an impeller according to exemplary embodiments in the present disclosure are described in detail with reference to the accompanying drawings.

A water pump including a supporting structure for an impeller according to a first exemplary embodiment in the present disclosure may include: a shaft; an impeller; a core; a magnetic material; a pump housing; and a supporting member.

Figure 1:
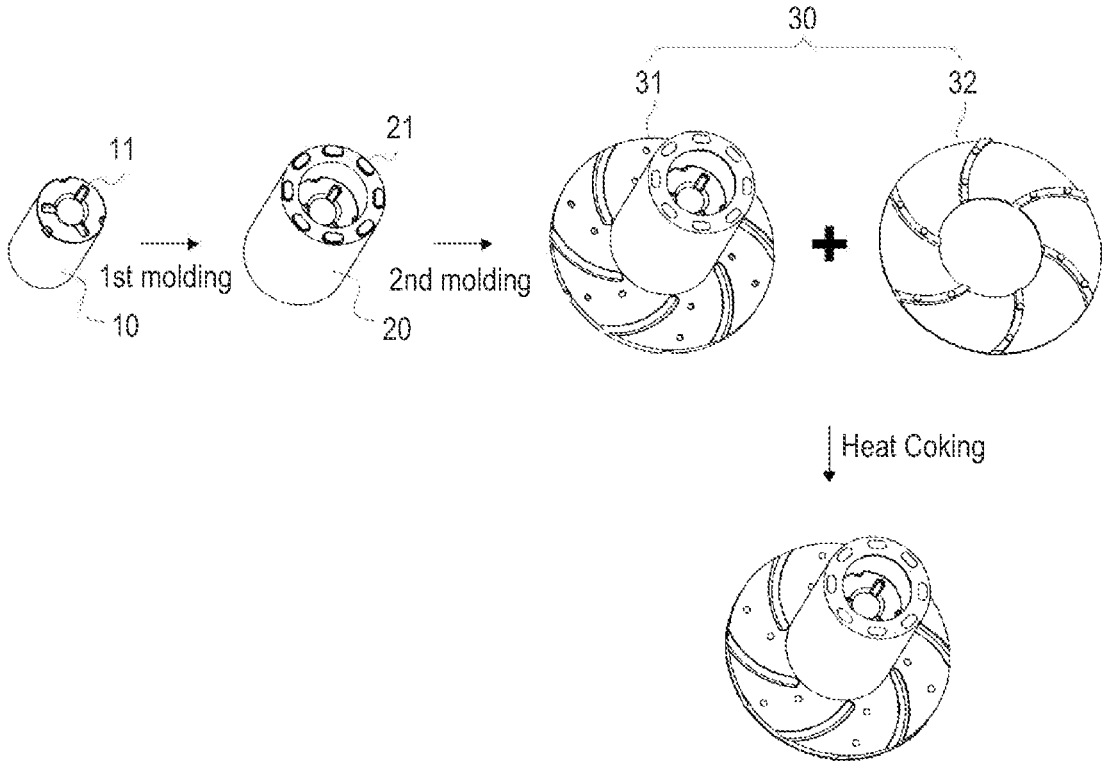
FIG. 1 is a flowchart illustrating a manufacturing process of a conventional water pump including an impeller.
Figure 2:
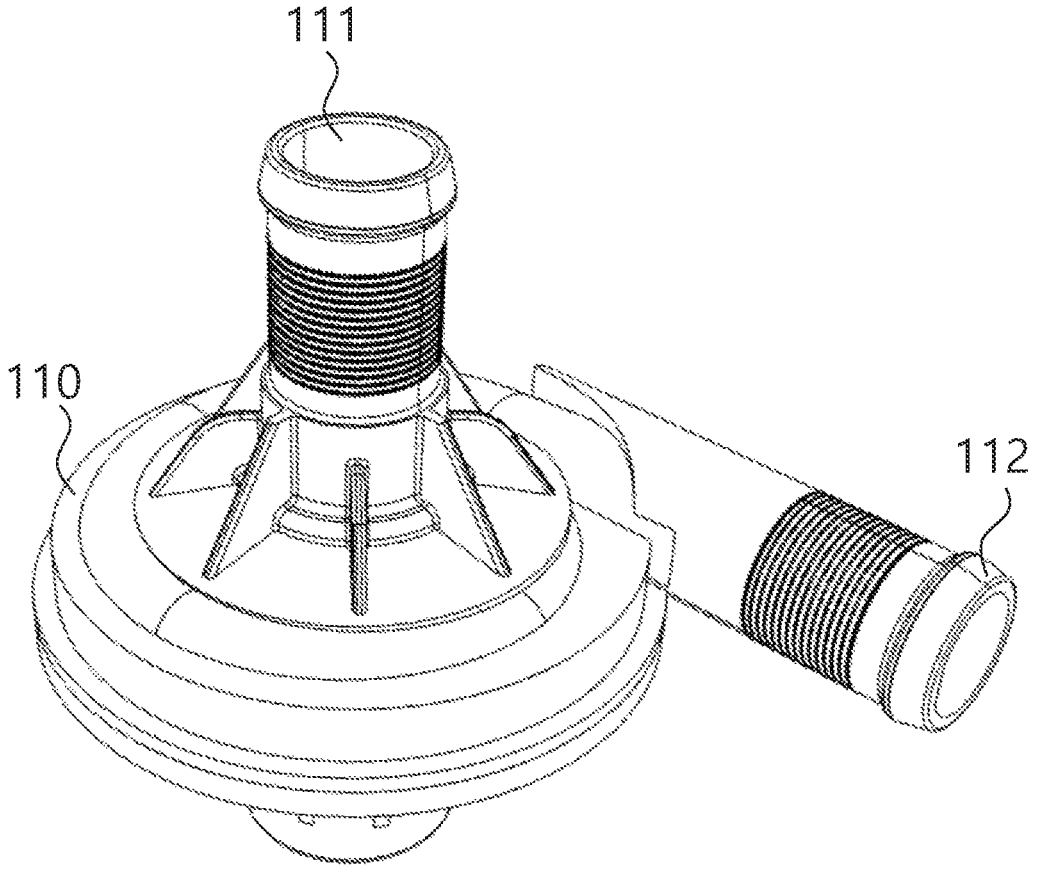
FIG. 2 is a perspective view of an upper portion of a water pump including a supporting structure for an impeller according to a first exemplary embodiment in the present disclosure.
Figure 3:
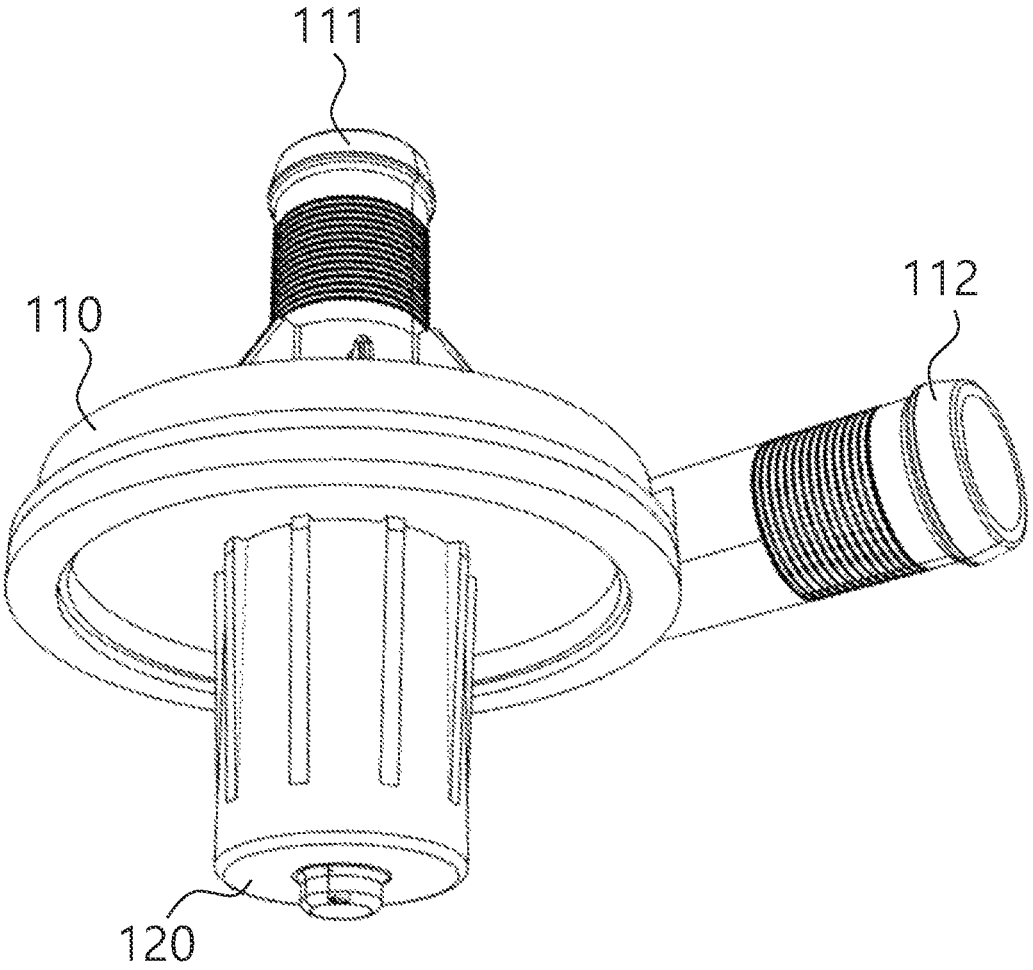
FIG. 3 is a perspective view of a lower portion of the water pump including a supporting structure for an impeller according to a first exemplary embodiment in the present disclosure.

FIG. 2 illustrates an upper appearance of a water pump including a supporting structure for an impeller according to a first exemplary embodiment in the present disclosure; and FIG. 3 illustrates a lower appearance of the water pump including a supporting structure for an impeller of the present disclosure.

An upper housing 110 and a lower housing 120 respectively illustrated in FIGS. 2 and 3 are included in the pump housing and assembled or coupled to each other to form a housing space therein; and the housing space houses, the shaft, the impeller, the core and the magnetic material, which are other components of the water pump including a supporting structure for an impeller according to a first exemplary embodiment in the present disclosure described above.

As illustrated in FIG. 2, the upper housing 110 may be an upper portion of the pump housing and may include an inlet 111 connected to an inside of the pump housing. According to a first exemplary embodiment in the present disclosure, fluid discharged from the water pump including a supporting structure for an impeller may be introduced into the inlet 111, and a separate flow passage may be connected to the inlet 111.

The inlet 111 illustrated in FIG. 2 may be formed in a vertical direction so that rotation of the impeller (not illustrated) inside the pump housing is not disturbed by fluid introduced into the inside of the pump housing through the inlet 111. The fluid is introduced in the same direction as a direction of a rotation axis of the impeller, and thus fluid supplied into a central portion of the impeller does not significantly affect a rotational motion of the impeller.

The fluid introduced into the pump housing through the inlet 111 is discharged to an outlet 112 formed at the upper housing 110 in a horizontal direction by an impeller to be described below. The outlet 112 is connected to the inside of the pump housing, and may be formed in a direction tangential to an outer circumference of the rotating impeller. In a first exemplary embodiment in the present disclosure, it is limited that the outlet 112 is formed only in the horizontal direction, i.e. a direction tangential to the outer circumference of the rotating impeller, so that the water pump according to the embodiment has a maximal pumping efficiency. However, the present disclosure does not limit that the outlet 112 is to be formed only in the direction tangential to the outer circumference of the rotating impeller as illustrated in the embodiments in FIGS. 2 and 3. The outlet 112 may be formed in any direction of the pump housing as long as the fluid introduced into the pump housing by the impeller may be discharged.

The upper housing 110 and the lower housing 120 illustrated in FIGS. 2 and 3 may be coupled to each other by a coupling member such as a bolt or a fitting structure. In addition, the upper housing 110 and the lower housing 120 may be made of various materials, and may be preferably made of synthetic resin for economical efficiency and easy manufacturing.

Figure 4:
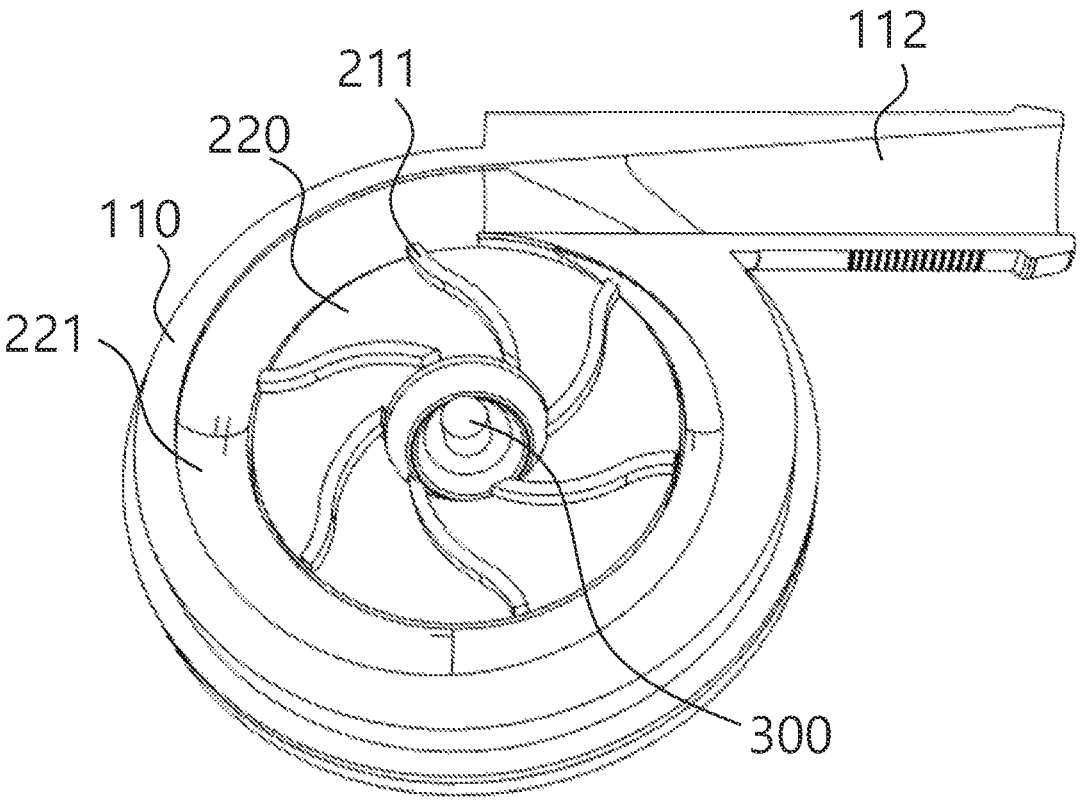
FIG. 4 is a horizontal cross-sectional view of the water pump including a supporting structure for an impeller according to a first exemplary embodiment in the present disclosure.

FIG. 4 is a horizontal cross-sectional view of an upper housing 110 of a water pump including a supporting structure for an impeller according to a first exemplary embodiment in the present disclosure.

FIG. 4 illustrates that an outlet passage 221 formed at an outer circumference of a rotating lower impeller 220 included in the impeller is finally connected to the outlet 112. As illustrated in FIGS. 2 and 3, the fluid introduced into the inlet 111 may be introduced into a central portion as illustrated in FIG. 4, i.e. a shaft 300; moved outwardly by the rotation of the impeller including the lower impeller 220; and then discharged outwardly of the pump housing through the outlet passage 221 and the outlet 11.

The impeller may be formed by assembling the lower impeller 220 illustrated in FIG. 4 and the upper impeller to be described below to each other. The impeller may be coupled to the shaft 300, and thus may rotate together with the shaft 300 as the shaft 300 rotates.

The impeller may have a structure from which the fluid is directly discharged, and may thus include a blade 211 directly pushing out the fluid illustrated in FIG. 4.

In the embodiment illustrated in FIG. 4, the blade 211 is formed in the upper impeller, but the present disclosure is not limited thereto. According to another embodiment, the blade may be formed in the lower impeller 220 and then the lower impeller 220 may be coupled to the upper impeller in which the blade is not formed. Alternatively, the blades may be respectively formed in the upper and lower impellers and then the upper and lower impellers may be coupled to each other.

Figure 5:
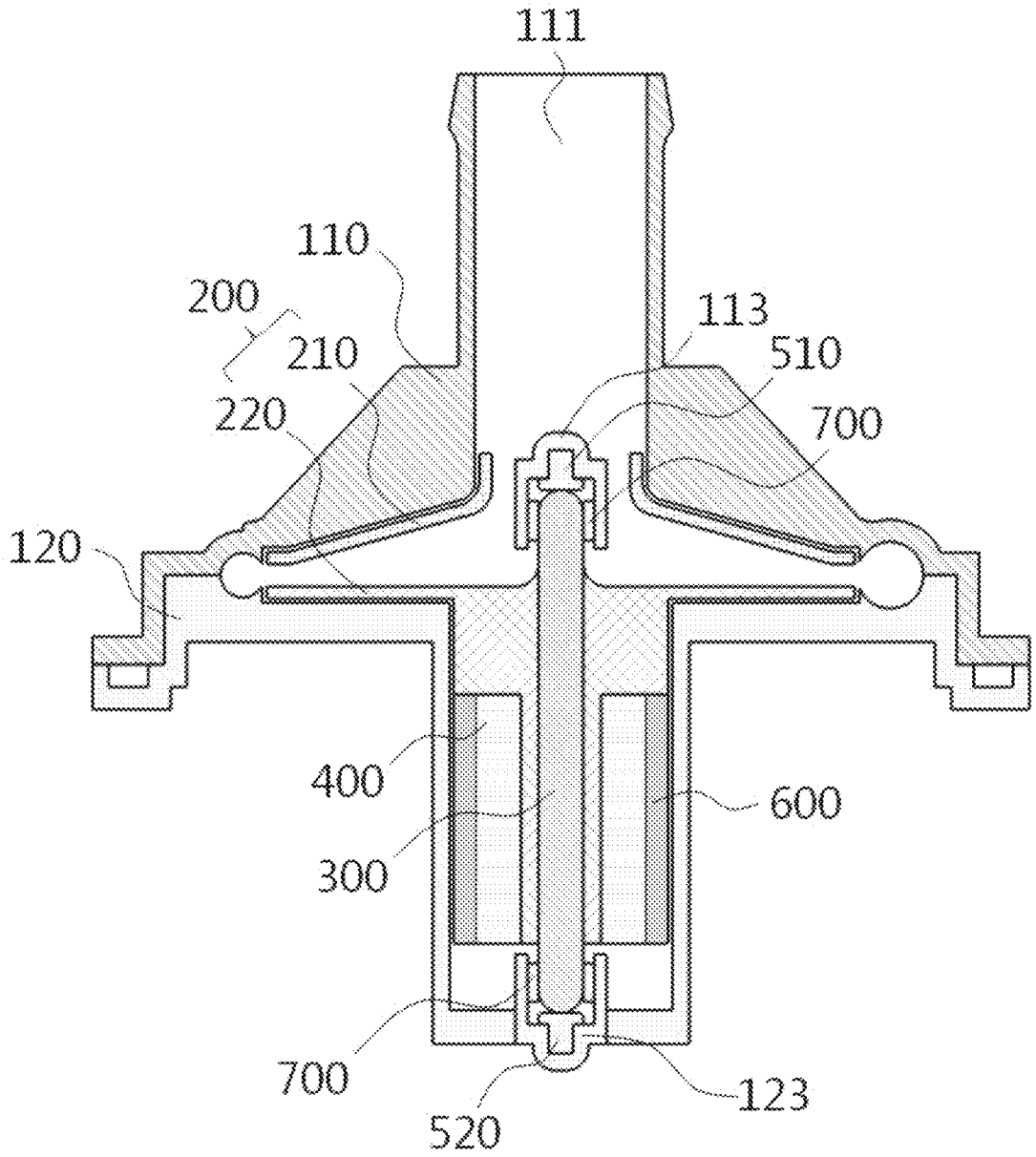
FIG. 5 is a vertical cross-sectional view of the water pump including a supporting structure for an impeller according to a first exemplary embodiment in the present disclosure.

FIG. 5 is a vertical cross-sectional view of a water pump including a supporting structure for the impeller according to a first exemplary embodiment in the present disclosure as illustrated in FIGS. 2 and 3.

As illustrated in FIG. 5, the shaft 300 rotates installed inside the pump housing including the upper housing 110 and the lower housing 120; and an upper end of the shaft 300 is housed in an upper supporting structure 113 formed inside the upper housing 110 and a lower end of the shaft 300 is housed in a lower supporting structure 123 formed inside the lower housing 120. The shaft 300 is rotated by the motor, but the upper and lower housings 110 and 120 are not rotated. Therefore, the shaft 300 is required to be supported so that a rotational force of the shaft 300 is not transmitted to the upper and lower housings 110 and 120 and the shaft 300 is not displaced by rotation. To this end, in the present disclosure, the shaft 300 may include a first support 510 and a second support 520 as supporting members respectively positioned at the upper and lower ends of the shaft 300; and the first support 510 and the second support 520 may respectively support the shaft 300 at the upper and lower ends of the shaft 300.

As illustrated in FIG. 5, the first support 510 as the supporting member may have a sectional shape in which a portion inserted into the upper supporting structure 113 is narrow, a portion facing the shaft 300 is wide, and one surface facing the shaft 300 is flat. In addition, when the one surface of the first support 510 is flat, an end of the shaft 300 in contact with the one surface of the first support 510 may protrude toward the first support 510, while having a curvature. In this case, the shaft 300 and the first support 510 may be in point contact with each other, such that the first support 510 may support the shaft 300 with a minimized frictional force. Also, even though the one surface of the first support 510 is worn by rotation of the shaft 300, a portion of the end of the shaft 300 may be inserted into the worn one surface of the support 510, and thus the shaft 300 may rotate. Accordingly, a rotation axis of the shaft 300 may not be shaken.

The second support 520 as the supporting member has the same structure as the first support 510; and the second support 520 may be different from the first support 510 in being positioned at the lower end of the shaft 300 to support the shaft 300. Therefore, a detailed description thereof is omitted.

Described above is a case where the first support 510 and the second support 520 are worn; however, the first support 510 and the second support 520 may be made of a material less likely to be worn by friction with the shaft 300.

The first support 510 and the second support 520 may be installed in a gravity direction, i.e. a loading direction of the shaft 300, to support the shaft 300 and the impeller 200 coupled to the shaft 300. Accordingly, the water pump according to the present disclosure may have a more simplified structure compared to a conventional structure to support the shaft 300, and may thus have reduced noise and vibration characteristics and a lower manufacturing cost.

Separate lubrication means may be used between the first and second supports 510 and 520 and the upper and lower supporting members 113 and 123, respectively, to further reduce frictional forces between the first and second supports 510 and 520 and the upper and lower supporting members 113 and 123, respectively. A common lubricant may be used as the lubrication means.

As illustrated in FIG. 5, a core 400 and a magnetic material 600 may be installed at a lower portion of the shaft 300, i.e. between the shaft 300 and the lower housing 120, to rotate the shaft 300.

The core 400 serving to supply current to the rotating the rotor may be made of carbon; and a magnetic material 600 serving as a stator may be formed on an outer circumference of the core 400. The shaft is rotated by the rotor.

The magnetic material 600 may include a permanent magnet to serve as the stator, and the permanent magnet may be a magnetic material such as a neodymium magnet.

As illustrated in FIG. 5, bearings 700 may be further provided at the upper and lower supporting structures 113 and 123 respectively housing the both ends of the shaft 300, to further support the shaft 300. The bearing 700 may be a common ball bearing, and is not limited thereto.

Figure 6:
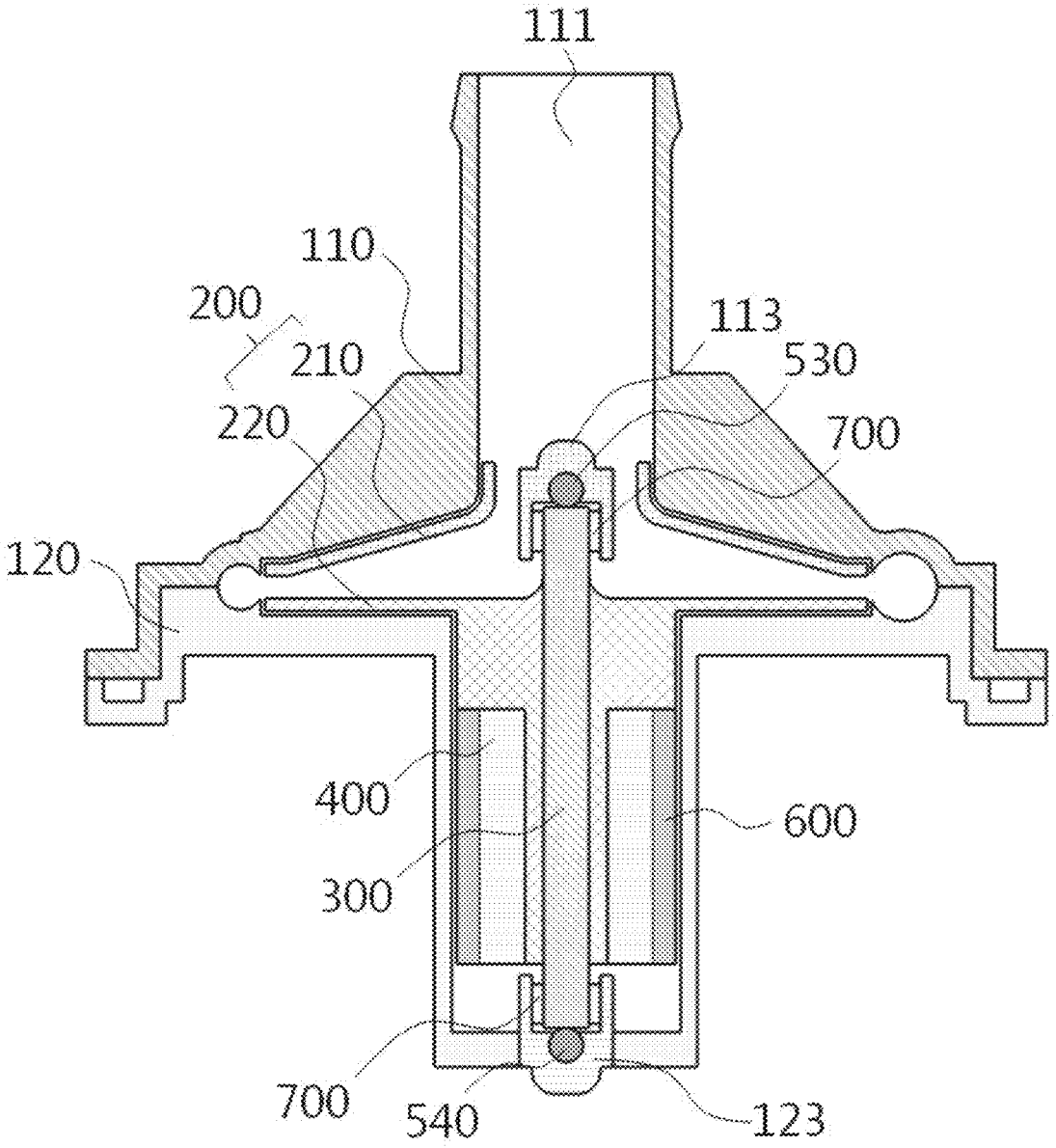
FIG. 6 is a vertical cross-sectional view of a water pump including a supporting structure for an impeller according to a second exemplary embodiment in the present disclosure.

FIG. 6 is a vertical cross-sectional view of a water pump including a supporting structure for an impeller according to a second exemplary embodiment in the present disclosure.

As illustrated in FIG. 6, the water pump including a supporting structure for an impeller according to a second exemplary embodiment in the present disclosure and the water pump including a supporting structure for an impeller according to a first exemplary embodiment in the present disclosure are different from each other in that the supporting members in a first embodiment are the first support 510 and the second support 520, whereas the supporting members in a second embodiment are a first ball 530 and a second ball 540.

As illustrated in FIG. 6, when the supporting members are the first ball 530 and the second ball 540, one surface of the shaft 300 may be flat, such that the first ball 530 and the second ball 540 and the one surface of the shaft 300 may be in point contact with each other, respectively. Accordingly, the both ends of the shaft 300 may be supported with minimized frictional forces, respectively.

As illustrated in FIG. 6, when the supporting members are the first ball 530 and the second ball 540 according to the present embodiment, the upper and lower supporting structures 113 and 123 may have inner surfaces of housing spaces formed corresponding to curved surfaces of the first ball 530 and the second ball 540 to house the first ball 530 and the second ball 540 therein, respectively.

As described above, according to the water pump including a supporting structure for an impeller in the present disclosure, the supporting members formed at the both ends of the shaft may support the shaft rotating while being coupled to the impeller. As a result, the water pump according to the present disclosure may have reduced noise and vibration characteristics caused by the rotations of the shaft and the impeller coupled to the shaft, and may have a lower manufacturing cost compared to the conventional water pump due to a more simplified structure.

The present disclosure is not limited to the abovementioned exemplary embodiments, but may be variously applied, and may be variously modified without departing from the gist of the present disclosure claimed in the claims.

The invention claimed is:

1. A water pump including a supporting structure for an impeller, the water pump comprising:

a shaft;

the impeller having the shaft inserted into a center of the impeller and rotating together with the shaft to discharge an introduced fluid;

a core formed on an outer circumference of the shaft;

a magnetic material formed on an outer circumference of the core and forming a magnetic field rotating the shaft connected to the core and the impeller;

an upper housing;

a lower housing assembled to the upper housing and housing the shaft, the impeller, and the core therein with the upper housing;

a first support installed between an upper end of the shaft and the upper housing, and in contact with the shaft to support the shaft;

a second support installed between a lower end of the shaft and the lower housing, and in contact with the shaft to support the shaft;

an upper supporting structure formed in the upper housing to house the first support and the upper end of the shaft; and a lower supporting structure formed in the lower housing to house the second support and the lower end of the shaft;

wherein when at least one of the first support and the second support has a curved surface in contact with the shaft, one end of the shaft in contact with the curved surface is flat, and wherein when at least one of the first support and the second support has a flat surface in contact with the shaft, one end of the shaft in contact with the curved surface is curved.

2. The water pump including the supporting structure for the impeller of claim 1, further comprising a bearing provided between at least one of the upper supporting structure and the lower supporting structure and an outer circumference of an end of the shaft.

3. A water pump including a supporting structure for an impeller, the water pump comprising:

a shaft;

the impeller having the shaft inserted into a center of the impeller and rotating together with the shaft to discharge an introduced fluid;

a core formed on an outer circumference of the shaft;

a magnetic material formed on an outer circumference of the core and forming a magnetic field rotating the shaft connected to the core and the impeller;

an upper housing;

a lower housing assembled to the upper housing and housing the shaft, the impeller, and the core therein with the upper housing;

a first support installed between an upper end of the shaft and the upper housing, and in contact with the shaft to support the shaft;

a second support installed between a lower end of the shaft and the lower housing, and in contact with the shaft to support the shaft;

an upper supporting structure formed in the upper housing to house the first support and the upper end of the shaft; and a lower supporting structure formed in the lower housing to house the second support and the lower end of the shaft;

wherein at least one of the first support and the second support is a spherical ball, and between the lower supporting structure and the upper supporting structure a partial inner portion of the upper and lower supporting structures housing a ball has a curved shape corresponding to a curved surface of the ball to house the ball.

4. The water pump including the supporting structure for the impeller of claim 3, further comprising a bearing provided between at least one of the upper supporting structure and the lower supporting structure and an outer circumference of an end of the shaft.

* * * * *